United States Patent [19]

Gärtner et al.

[11] 4,421,234

[45] Dec. 20, 1983

[54] CYLINDRICAL VESSEL WITH A BASE RING AND WITH A COUPLING DEVICE

[75] Inventors: Robert Gärtner, Langen; Klaus-Dieter Maass, Eppstein; Georg Senninger, Hattersheim am Main, all of Fed. Rep. of Germany

[73] Assignee: Hoechst Aktiengesellschaft, Frankfurt am Main, Fed. Rep. of Germany

[21] Appl. No.: 409,945

[22] Filed: Aug. 20, 1982

[30] Foreign Application Priority Data

Aug. 22, 1981 [DE] Fed. Rep. of Germany ..... 3133316

[51] Int. Cl.[3] ..... B65D 21/02

[52] U.S. Cl. ..... 206/509; 206/510; 220/85 P

[58] Field of Search ..... 220/85 P; 206/509, 510

[56] References Cited

U.S. PATENT DOCUMENTS

| | | | |
|---|---|---|---|
| 877,816 | 1/1908 | Whitehead | 206/510 |
| 1,220,710 | 3/1917 | White | 206/510 |
| 2,775,364 | 12/1956 | Inden | 206/509 |

FOREIGN PATENT DOCUMENTS

| | | | |
|---|---|---|---|
| 514045 | 9/1952 | Belgium | 220/85 P |
| 1189519 | 10/1959 | France | 220/85 P |
| 754791 | 8/1956 | United Kingdom | 206/510 |

*Primary Examiner*—George E. Lowrance

*Attorney, Agent, or Firm*—Curtis, Morris & Safford

[57] ABSTRACT

In this cylindrical vessel with a base ring and with a coupling device, the base ring has two guide segments located opposite one another. On the head of the vessel there are supports which carry two ring segments arranged opposite one another. When two vessels are coupled to one another, the ring segments engage behind the guide segments to make a bayonet connection.

6 Claims, 3 Drawing Figures

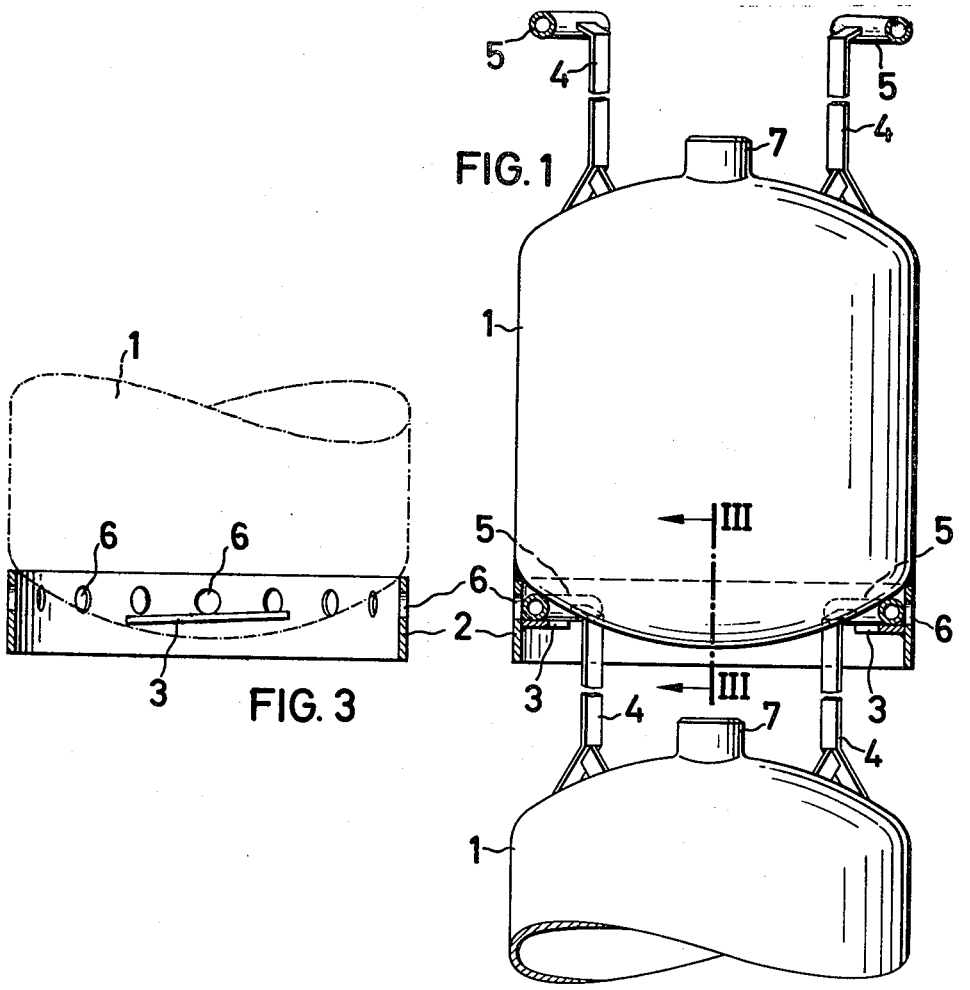
FIG. 1
FIG. 3
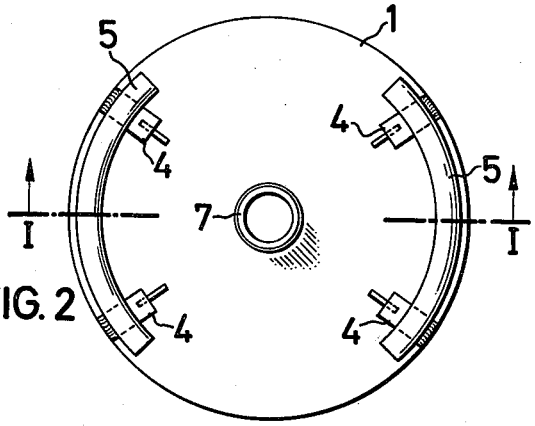
FIG. 2

CYLINDRICAL VESSEL WITH A BASE RING AND WITH A COUPLING DEVICE

The invention relates to a cylindrical vessel with a base ring and with a coupling device which makes it possible to connect such vessels to one another.

To avoid the need to cover unnecessary distances to obtain additional stores, it is expedient, for example in the maintenance of refrigerating plants, to have many different refrigerating agents on hand at all times. The object is, therefore, to provide a vessel, especially for gases and/or liquids, which can be ganged to identical vessels, e.g., by suspending one from another or mounting one atop another, to form interconnected units.

The object is achieved by means of a cylindrical vessel with a base ring and with a bayonet coupling device, wherein (a) the base ring has two guide segments located opposite one another, and (b) there are on the head of the vessel supports which carry two ring segments arranged opposite one another.

The guide segments can be made self-locking and can be inclined up to 3° relative to the normal of the vessel axis.

The advantages achieved as a result of the invention are to be seen basically in that by means of the coupling device cylindrical vessels can be coupled rigidly to form relatively large units and can consequently also be stacked advantageously. Several vessels can be carried at the same time. For transport, the vessels can be fastened simply and effectively to the transport vehicle, provided that, for example, the base ring is mounted on the transport bed by means of the segments located opposite one another.

The invention is explained in more detail below with reference to drawings which illustrate one embodiment only and in which:

FIG. 1 shows a side view, partially in section, of two vessels connected to one another, FIG. 2 shows a plan view of a vessel, and FIG. 3 shows a section along the line III—III of FIG. 1.

The cylindrical vessel 1 is provided with a base ring 2 which has two guide segments 3 located opposite one another. The guide segments 3 can be made self-locking, for example they can be gummed or surface-treated in another way. Furthermore, they can be inclined up to 3° relative to the normal of the vessel axis. Supports 4 are located opposite the base ring 2, that is to say consequently on the head of the vessel 1, so that they can carry two ring segments 5 located opposite one another. When two vessels are coupled to one another, the ring segments 5 engage behind the guide segments 3, as a result of which the rigid connection between the vessels is made. 6 denotes orifices in the base ring and 7 denotes the filling connection of the vessel.

We claim:

1. In a cylindrical vessel having a base and a head opposite the base, a base ring extending below its base, and a pair of oppositely-disposed support members extending upward from its head; the improvement wherein, to adapt the vessel to be lockably ganged to another like vessel, a bayonet fitting is provided including a pair of guide segments extending circumferentially on an inner side of the base ring and defining circumferential gaps between the guide segments, and a respective pair of ring segments extending radially outward from the respective support members to engage a like cylindrical vessel thereabove between its base and its guide segments.

2. The cylindrical vessel as claimed in claim 1, wherein said guide segments include means for self-locking to the ring segments of a like cylindrical vessel.

3. The cylindrical vessel as claimed in claim 2, wherein said self-locking means includes gum or the like surface treatment of the guide segments.

4. The cylindrical vessel as claimed in claim 1, wherein said guide segments are inclined at a small angle relative to the normal of the vessel axis.

5. The cylindrical vessel as claimed in claim 4, wherein said small angle is substantially 3°.

6. The cylindrical vessel as claimed in claim 5, wherein said ring segments define circumferential gaps therebetween at least slightly larger than the circumferential extent of the guide segments, thereby permitting the cylindrical vessels to be ganged together by the ring segments of one vessel behind the guide segments of another vessel.

* * * * *